United States Patent [19]

Wakai

[11] 4,344,161

[45] Aug. 10, 1982

[54] ELECTRONIC TIMEPIECE

[75] Inventor: Yoichi Wakai, Suwa, Japan

[73] Assignee: Kabushiki Kaisha Suwa Seikosha, Tokyo, Japan

[21] Appl. No.: 118,707

[22] Filed: Feb. 5, 1980

[30] Foreign Application Priority Data

Feb. 9, 1979 [JP] Japan ..... 54/13990
Dec. 21, 1979 [JP] Japan ..... 54/167140

[51] Int. Cl.[3] ..... G04C 17/00; G04B 23/02; G04C 9/00

[52] U.S. Cl. ..... 368/69; 368/73; 368/187; 368/321

[58] Field of Search ..... 368/69–70, 368/72–74, 185–188, 250–251, 308, 319–321; 200/4, 6 R, 159 R, 159 A

[56] References Cited

U.S. PATENT DOCUMENTS

| | | | |
|---|---|---|---|
| 3,823,551 | 7/1974 | Biehl | 368/66 |
| 3,834,152 | 9/1974 | Nishimura et al. | 368/321 |
| 3,975,897 | 8/1976 | Naito | 368/187 |
| 4,034,551 | 7/1977 | Ushiyama | 368/320 |
| 4,095,405 | 6/1978 | Tanaka | 368/321 |
| 4,121,414 | 10/1978 | Yamazaki | 368/261 |
| 4,135,359 | 1/1979 | Yajima | 368/69 |
| 4,246,650 | 1/1981 | Moritani et al. | 368/69 |

*Primary Examiner*—Vit W. Miska
*Attorney, Agent, or Firm*—Blum, Kaplan, Friedman, Silberman and Beran

[57] ABSTRACT

A single external stem member of an electronic timepiece operates independent switches by push-pull motions and by a rotary operation. Many functions are controlled or adjusted with signals generated by particular sequential combinations of stem member operations in the push-pull and rotary modes. In an alarm timepiece, the rotary switch controls the alarm time setting, and the push-pull switch determines whether an audible alarm and hour markers are to sound, no sounds are to be emitted, or only the alarm is to sound.

21 Claims, 8 Drawing Figures

FIG. 7
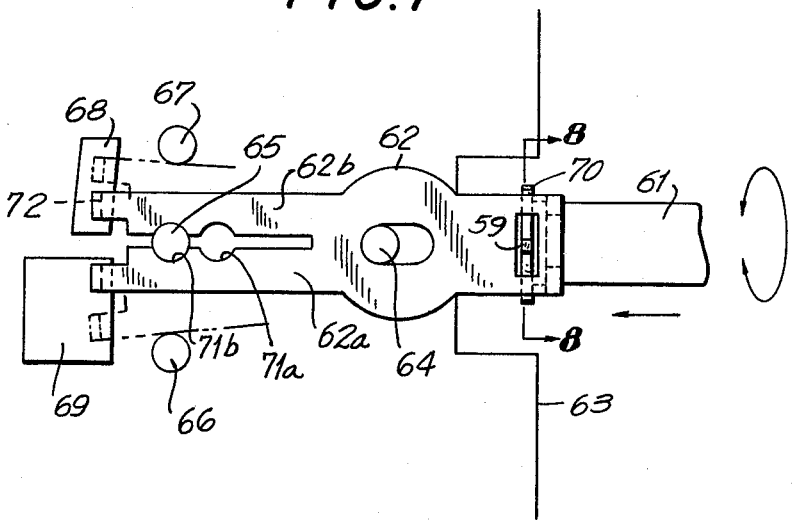
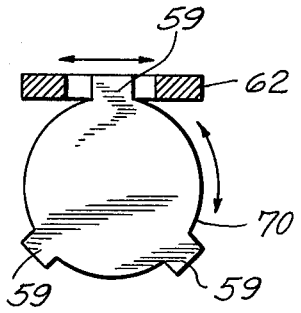
FIG. 8

ELECTRONIC TIMEPIECE

BACKGROUND OF THE INVENTION

This invention relates generally to an electronic timepiece of the digital type and more particularly to an electronic timepiece wherein an external stem member operates independent switches by both push-pull and rotary motion. In the prior art, analog display electronic timepieces having hands and mechanical driving mechanisms have employed a stem-type switch for setting the hands on the display. Also, in a digital display electronic timepiece using liquid crystals and the like, introduction of a stem-type switch has been considered. However, the conventional digital electronic timepiece of the prior art generally includes a plurality of pushbutton switches serving as input means to control and adjust various functions. These switches perform functions such as changing the display mode, selection of a digit which is to be corrected in a display, and correction of the selected digit. The input signals to the timepiece are controlled by actuations, that is, generally by pressing these button switches in particular sequences and combinations.

On the other hand, a stem-type switch can serve both as a push-pull switch and as a rotary switch. Thereby, a stem-type switch can greatly reduce the number of switch devices which are required to control functions and operating modes of a timepiece as compared with usage of pushbutton switches. A single stem-type switch can fulfill many necessary functions where the switch is so arranged that a plurality of stable conditions are established by each push and pull of the stem and also different switch inputs are provided by rotating the stem. For example, the push-pull portion of the switch changes the functional mode, for example, from the time mode to the calendar mode, and the rotary switch portion corrects the displayed indications.

What is needed is an electronic timepiece having an external stem which performs various functions by an interrelation between rotary switch portions and push-pull switch portions associated with the external stem member.

SUMMARY OF THE INVENTION

Generally speaking, in accordance with the invention, an electronic digital timepiece having an external stem member especially suitable for controlling a plurality of functions is provided. The external stem member operates independent switches by push-pull motions and by rotary operation. Many functions are controlled or adjusted with signals generated by particular sequential combinations of operations in the push-pull and rotary modes. In an alarm timepiece, the rotary switch elements control the alarm time setting, and the push-pull switch elements determine whether an audible alarm and hour indicators are to sound, no sounds are to be emitted, or only the alarm is to sound. The sound-emitting options are selected in various combinations by successive push-pull operations of the external member.

Basically, when the stem is pulled and pushed, the switch is used to change modes of display. When the stem is in a pulled condition, rotation of the stem is used to change digits and characters in the displayed mode, for example, making corrections in the displayed time, the alarm set time and the like. In another embodiment of a timepiece using a stem switch having both push-pull and rotary contacts, a stem-type switch has a stable position for correcting the alarm time brought about by pushing or pulling the stem. When the time is then corrected by rotation of the stem, the time displayed is advanced or retarded in accordance with the rotational direction of the stem, and the amount of time correction is responsive to the amount of stem rotation.

In other alternative embodiments of this invention, the stem switch is used to change the displayed function between a 24-mode and a 12-hour mode. In another alternative embodiment, the stem switch is used to change the display between the functions of seconds and dates. Resetting the display of seconds to zero is also accomplished by means of a stem switch in another alternative embodiment of this invention.

Accordingly, it is an object of this invention to provide an improved electronic timepiece incorporating an external member similar to that used in analog timepieces for setting and adjusting portions of a digital display.

Another object of this invention is to provide an improved electronic timepiece having an external stem member which performs a plurality of switching functions dependent upon pulling and pushing the stem member and rotating the stem member.

A further object of this invention is to provide an improved electronic timepiece wherein sound-emitting functions and alarm time setting are controlled by a single external member capable of push-pull and rotational operation.

Still another object of this invention is to provide an improved electronic timepiece wherein push-pull operation of a single external member determines the functions to be displayed or performed and rotation of said external member sets or corrects a displayed function.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 6 and 7 are plan views of a switching device for the timepieces in accordance with this invention; and FIG. 8 is a sectional view of the switching device of FIGS. 6 and 7 taken along line 8—8 of FIG. 7.

DESCRIPTION OF THE PREFERRED EMBODIMENTS

Figure 1:
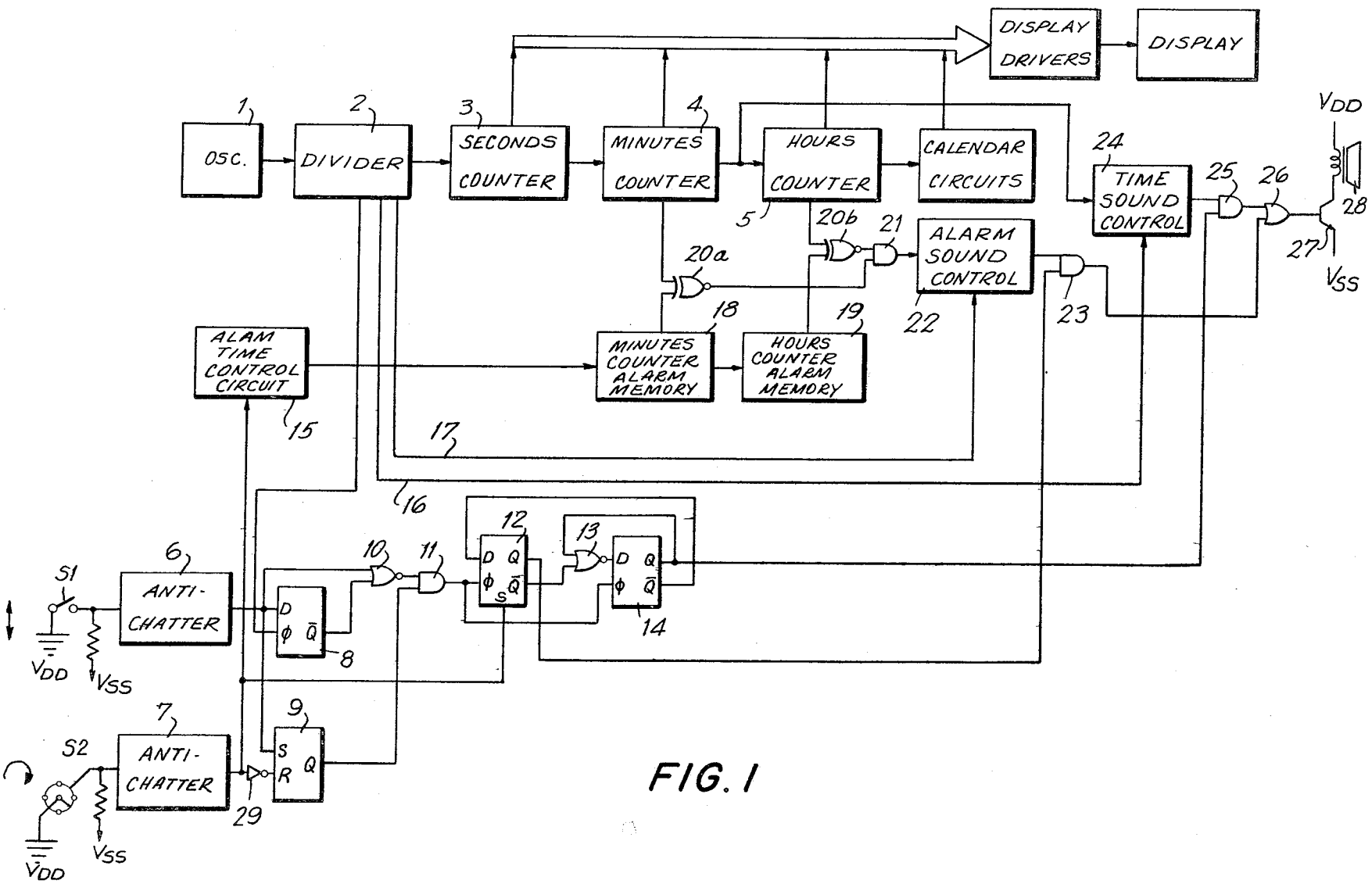
FIG. 1 is a circuit of an electronic timepiece in accordance with this invention.

First, an embodiment of an electronic timepiece in accordance with this invention having an alarm function is described. With reference to FIG. 1, a time standard signal oscillator circuit 1 includes a quartz crystal vibrator and the like for generating a time standard signal which is applied to a divider 2. Outputted from the divider 2, a 1-second (1 Hz) signal is applied to a seconds counter 3 which delivers a 1-minute signal to the minutes counter 4. Every 60 minutes, the minutes counter 4 delivers a 1-hour signal to the hour counter 5.

S1 is a push-pull switch portion of a stem-type switching device, and S2 is a rotary switch portion of the same stem-type switching device. Antichatter circuits 6, 7 respectively associate with switches S1 and S2 to assure that circuit inputs are clearly defined signals. The signal produced by rotation of the switch S2 is applied through the antichatter circuit 7 to a circuit 15 for controlling signals used in correcting the alarm time, whereby the alarm time setting can be changed. A minutes counter 18 and an hours counter 19 are used as memories for the alarm time setting.

Pulling the external stem of the switching device closes the switch S1 and corresponds to ON, and pushing the stem opens switch S1 and corresponds to OFF. When the switch S1 is turned ON or OFF, namely, pulled or pushed, an input signal via the antichatter circuit 6 is applied to a D-type data flip-flop 8 which is clocked by a high-frequency signal from the divider 2. When an input signal is not applied by the switch S2, that is, the switch S2 is not rotated and its contacts are open, the output signal from the antichatter circuit 7 is low. In this nonrotated condition of the switch S2, the reset input R of the set-reset-type latch circuit 9, comprising NAND gates, is high by reason of an intermediate inverter 29. Thus, the output Q of the latch 9 is determined only by the set input S and the Q output is usually high.

A NOR gate 10 outputs a differential signal in response to the input of the output signal $\overline{Q}$ of the D-type flip-flop 8 and the data input signal outputted from the antichatter circuit 6. The differential signal is delivered from the NOR gate 10 at the time of the fall of the ON signal from the antichatter circuit 6, that is, when the switch S1 is pushed to the OFF condition. The differential signal then passes through an AND gate 11 and is a clock signal for the D-type flip-flop counters 12 and 14. The AND gate 11 allows the output of the NOR gate 10 to pass, as stated above, because the output Q of the D-type flip-flop 9 is high when the switch S2 is open.

Coincidence between a preselected alarm time and the actual time is detected by the exclusive NOR gates 20*a*, 20*b*, which respond to a coincidence in minutes between the minute counter 4 and the minute alarm memory 18 and a coincidence in hours between the hour counter 5 and the hour alarm memory 19. With coincidence, the outputs of the exclusive NOR gates 20*a*, 20*b* are high, and as a result, an output signal of high level from the AND gate 21 is applied to an alarm sound controlling circuit 22. The alarm sound controlling circuit 22 receives the high output of the AND gate 21 and a suitable alarm frequency signal from the divider 2 through a bus 17, and then delivers an alarm signal to one input of an AND gate 23. As explained hereinafter, the alarm signal is sounded depending upon the condition of the other input to the AND gate 23.

With regard to a time signal, used for sounding on the hour, the carry signal from the minutes counter 4 to the hours counter 5 is applied to a time signal sound controlling circuit 24 along with a suitable time sounding frequency signal delivered through a bus 16 from the divider 2. The output of the time signal sound controlling circuit 24 is then applied to one terminal of an AND gate 25. The state of the other input terminal to the AND gate 25 determines whether a sound is emitted as an hour marker as explained hereinafter.

Figure 2:
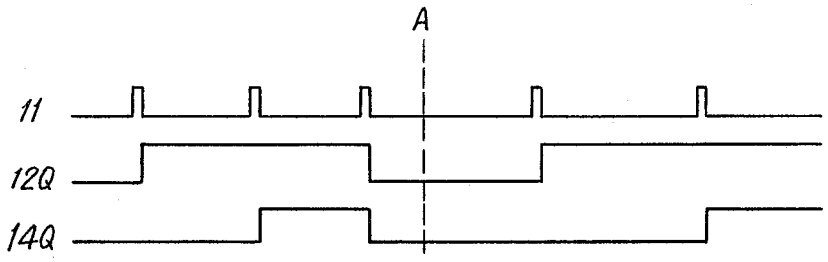
FIG. 2 is a timing chart indicating performance of particular components of the circuit of FIG. 1.

The AND gates 23, 25 are enabled by the outputs Q of the D-type flip-flops 12, 14, respectively. The output Q of the flip-flop 12 and the flip-flop 14 changes in response to outputs from the AND gate 11, as shown in the timing chart of FIG. 2. The Q output of flip-flop 12 goes high on the trailing edge of the first clocking signal from the AND gate 11. The Q output of the flip-flop 14 goes high on the second clock signal from the AND gate 11, and upon the occurrence of the third clock signal from the AND gate 11, both Q outputs of the flip-flops 12, 14 go low and return to their initial condition, whereby the above sequence repeats as additional pulses are inputted from AND gate 11. As stated above, each pulse from AND gate 11 is initiated by a pull-push operation of the switch S1.

The alarm and time signal functions are varied as follows in response to the condition of the Q output of the flip-flops 12, 14. These outputs are directly connected to the gates 23, 25, respectively.

| (12Q) | (14Q) | |
|---|---|---|
| low | low | both alarm and time signal sounds cannot be emitted |
| high | low | alarm sound can be emitted; time signal sound cannot be emitted |
| high | high | both alarm and time signal sounds can be emitted |

To summarize, when the Q outputs of both flip-flops 12, 14 are low, the gates 23, 25 which control the alarm and time marker sounds are blocked, and no sound is emitted from the timepiece. A single pull-push actuation of the switch S1 makes only the Q output of flip-flop 12 go high, whereby the AND gate 23 passes the alarm control signal when there is coincidence between the minute and hour counters and the minute and hour alarm memories. A time marker indicating the hour is still blocked and does not sound. A second actuation of the switch S1 makes both Q outputs of the flip-flops 12, 14 high, and both gates 23, 25 are enabled. Accordingly, upon coincidence of the minute and hour counters with the data stored in memory, the alarm will sound, and on each hour, as indicated by a carryover signal from the minute counter 4, a time marker sound will be emitted. A third pull-push actuation of the switch S1 returns the flip-flops 12, 14 to the initial low output state at the terminals Q, which blocks the sound from passing through the gates 23, 25. Thus, the user readily selects the mode of operation for the timepiece alarm and time marker soundings.

Next, the use of the rotary switch S2 in the circuit of FIG. 1 to correct the alarm time setting is described. First, the switch S1 is placed in the ON condition, that is, the switch S1 is pulled. By rotating the external member, the switch S2 outputs signals via the antichatter circuit 7 to the alarm time circuit 15 for controlling the alarm time setting. The signals produced by rotation of the switch S2 pass through the alarm time control circuit 15 and are inputted to the counter circuits 18, 19 to modify their settings. Simultaneously, the signal from the rotary switch S2, having passed through the antichatter circuit 7, also sets the D-type flip-flop 12. Thus, the output Q of the flip-flop 12 becomes high, and the AND gate 23 is enabled to allow the signal from the alarm sound controlling circuit 22 to pass, whereby an alarm sound will be emitted when due, and there is no need to especially operate the pull-push switch S1 to achieve this condition.

Adjusting the alarm time setting is completed using the rotary switch S2. However, the switch S1 remains in the ON condition, which was the first step in the alarm setting procedure. The signal from the rotary switch S2, by way of the antichatter circuit 7, also passes through the inverter 29 and resets the latch circuit 9. Thus, a low output Q from the latch circuit 9 is applied to the AND gate 11, which inhibits any signals from the AND gate 10 at that time. Thus, the differential signal produced at the time when the ON signal of switch S1 fails is not applied to the clock terminal of the flip-flop 12. Accordingly, the prior enablement of the alarm sounding circuits is not altered when the switch S1 is returned to the OFF position. The switch S1 is set to the OFF position after adjustment of the alarm setting using the rotary switch S2 has been completed. In turning the switch S1 OFF, the latch 9 is set again to have a high output at its Q terminal, and the AND gate 11 allows subsequent signals from the AND gate 10 to pass. Thus, the user is able to add enablement to the hour time sounding circuits or to disable the alarm sounding circuits as described above.

The signals from the AND gates 23, 25, when due, pass through an OR gate 26 and turn ON a transistor 27 which passes the current to drive a speaker 28 from which the alarm or time marker sound is actually emitted.

Figure 3:
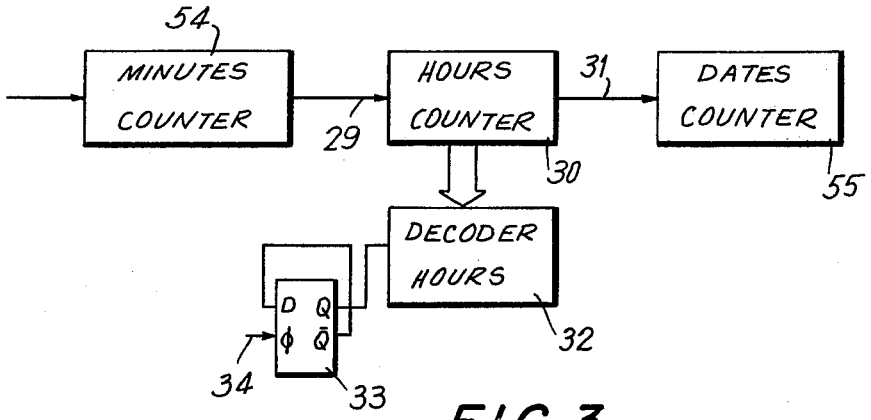
FIGS. 3, 4 and 5 are circuit diagrams of alternative embodiments in accordance with this invention.

An alternative embodiment of this invention is now described wherein the pull-push switch is used to change the mode of the hour display. In FIG. 3, an hours counter 30 receives a carryover signal 29 from a minutes counter 54 and outputs a carryover signal 31 to the dates counter 55. An hours decoder 32, which receives five bits of data from the hours counter 30, generates data for driving a display (not shown). Of these five data bits, four data bits are used for displaying the hour, and one bit is used for displaying data indicating AM or PM. A flip-flop 33 receives the signal 34 from the AND gate 11 shown in FIG. 1 as a clock signal (FIG. 2) when the pull-push switch S1 is actuated. The output Q of the flip-flop 33 is inverted by each input signal 34 and then applied to the hours decoder 45 to change its operational mode. For example, when the output Q of the flip-flop 33 is high, four bits of the five-bit signal from the hour counter 30 are devoted to hours data for a "12-hour display" and one bit thereof is devoted to AM and PM data. When the output Q is low after a clock pulse signal 34, the entire five-bit signal from the hours counter 30 is devoted to hour data as used in a 24-hour display. The next pulse signal 34 reverts the data to the four bit-one bit format. Thus, the pull-push operation of the stem switch device changes the display mode in this embodiment. These changes between the 12-hour and 24-hour display modes are performed solely by actuation of the pull-push switch S1 while the rotary switch S2 is not rotated.

Figure 4:
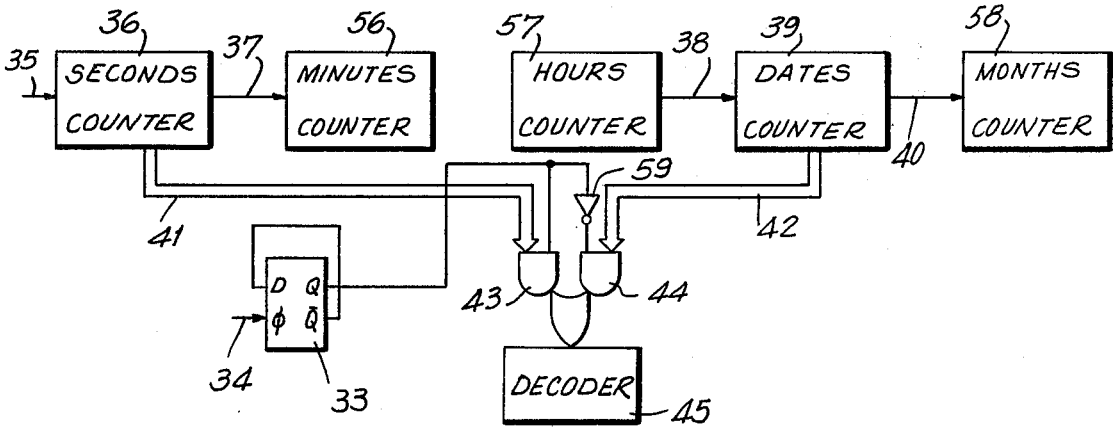

Another alternative embodiment according to this invention, wherein the external stem member is used to change the display modes, is described hereinafter. In FIG. 4, a seconds counter 36 receives and counts 1-second signals 35 from the divider 2 (FIG. 1) and delivers a carryover signal 37 to the minutes counter 56. A dates counter 39 receives and counts a carryover signal 38 from the hours counter 57 and applies a carryover signal to a months counter 58. The flip-flop 33 and a clock signal 34 perform the same functions as in the embodiment of FIG. 3, receiving signals from the AND gate 11 (FIG. 1). When the output Q of the flip-flop 33 is high, data 41 comprised of four bits from the seconds counter 36 is transmitted through the AND gate 43 and then to a decoder 45. The signal 42 from the dates counter 39 is inhibited at the AND gate 44 by the inverter 59 connected to the Q terminal of the flip-flop 33. On the other hand, when the output Q of the flip-flop 33 is low, the four-bit data 42 from the dates counter 39 is transmitted through the AND gate 44 and then to the decoder 45. At the same time, the signals 41 from the seconds counter 36 are inhibited by the AND gate 43, which has the low output Q of flip-flop 33 applied thereto. The code of the seconds signals 41 is the same as used with the dates signals 42 such that the decoder 45 serves for display of both seconds and dates functions. In this way, actuation of the pull-push switch S1 changes the display mode alternately between a seconds display and a dates display. The rotary switch S2 is not rotated during these operations.

Figure 5:
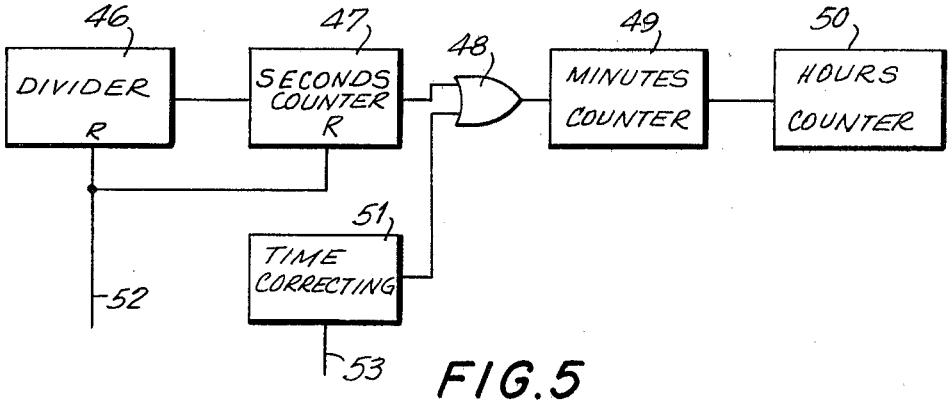

An embodiment wherein the seconds display is reset to zero is now described. In FIG. 5, a divider 46 applies 1-second signals to a seconds counter 47. The seconds counter 47 counts 60 seconds and then applies a 1-minute signal to a minutes counter 49 through an OR gate 48. The minutes counter 49 counts the minute signals up to 60 minutes and then applies an hour signal to an hours counter 50. A time-correcting circuit 51, similar to the circuit 15 of FIG. 1, receives an input signal 53 from the rotary switch S2 and transmits a time-correcting signal to the minutes counter 49 through the OR gate 48. This input signal 53 is the output signal from the antichatter circuit 7 of FIG. 1. When a time correction is not to be performed, that is, there is no input signal from the rotary switch S2, the differential signal generated by the NOR gate 10 when the pull-push switch S1 is actuated is inhibited at the AND gate 11. The AND gate 11 output is low because the output Q of the latch 9 is low. The output signal of the AND gate 11 is represented by the numeral 52 in FIG. 5. When the switch S2 is rotated, time is corrected, but the divider 46 and the seconds counter 47 are not reset. However, when an input signal is not applied from the rotary switch S2, a differential signal is generated as described above from the AND gate 11 when the pull-push switch S1 is pulled or pushed, and then the divider and the seconds counter are reset. With such a mechanism, correction of the time display without correcting the seconds display is easily performed, and timekeeping accuracy is maintained.

Figure 6:
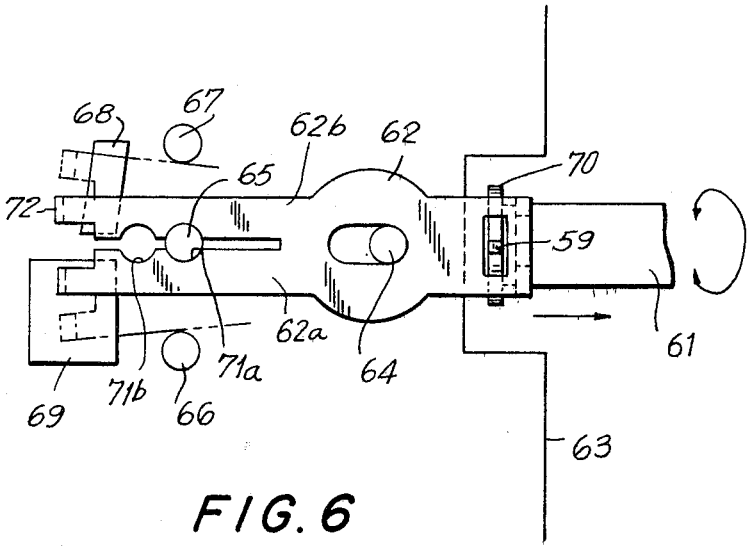

FIG. 6 shows a switch device which is operated by rotation in either of two directions and by pulling or pushing an externally operating means, that is, a stem 61. When the stem 61 is rotated clockwise, a cam 70 fixedly connected with the stem 61 engages a switch lever 62, as shown in FIG. 8. The switch lever 62 pivots around a pin 64. Thereby, a spring portion **62*a* thereof comes in contact with a switch pin 66. In this condition, the spring portion 62*a* of the lever 62 also makes contact with a copper foil pattern 69 formed on a circuit board 63. The spring portion 62*a* is connected to the positive terminal of a power source (not shown). When the stem 61 is rotated counterclockwise, a spring portion 62*b* of the switch lever 62 comes in contact with a switch pin 67, and the pin 67 is connected to the positive power supply terminal because the switch lever 62 connects to the positive terminal of the power source as mentioned above. The circumferential spacing of the cam teeth 59** and the resilient qualities of the lever portions 62*a, b* assure that the lever 62 oscillates about the pivot 64 as the stem 61 is rotated. Thereby, a sequence of makings and breakings of the switch contacts is produced as the stem 61 continues to be rotated. When the stem 61 is pulled rightward, as seen in FIG. 6, the switch lever 62 moves so that a click portion 71*a* of the stem 61 moves out of engagement with a post 65, and a click portion 71*b* of the stem 61 engages the post 65. At that time, the end 72 of the spring portion 62*b* of the switch lever 62 comes in contact with a copper foil 68 on the circuit board 63, so that the switch 68, 72 is turned ON. In this structure (FIGS. 6–8), the copper foil 68 and the switch lever 62 constitute a push-pull switch S1, and the switch lever 62 and the pins 66, 67 constitute the contacts of a rotary switch S2 as would be used with the previously described circuits.

By means of such a switching device, an electronic timepiece performing a plurality of functions, such as timekeeping, calendar display, alarm and a timer, can change the displayed function and can correct or set the display of each function by advancing or retarding displayed digits. When the stem 61 is rotated clockwise while the stem is pushed in as in FIG. 6, a time display is changed to the calendar display. Additional rotation changes the calendar display to the alarm display. Then, when the stem 61 is again rotated clockwise, th display mode is changed from the alarm display to the timer display. From any display mode, a counterclockwise rotation of the stem 61 returns the display to the time display mode.

When the stem 61 is pulled out, the function being displayed at the moment when the stem 61 is pulled can be corrected by switch rotation. For example, when the calendar is displayed, and the stem 61 is pulled, the calendar indication changes to the next higher digit when the stem 61 is rotated clockwise. When the stem 61 rotates counterclockwise, the calendar indication reverts to the next lower digit. Further, for other display modes, a correction of the function is performed in the same manner.

In all embodiments described above according to this invention, the operating method for a stem-type switch device combines a push-pull switch function with a rotary switch function. The additional functions controlled with a single external element make such a design extremely efficient. Also, in an alternative embodiment in accordance with this invention, as an additional function of a push-pull switch, there may be a capability for selecting an enabled condition or disabled condition for a sound emitter which confirms whether an input signal has or has not been initiated by the external member. This additional function may be operative only when the rotary switch is not rotated. As stated above, a single externally operated member combining a rotary switch with a push-pull switch can produce various combinations of switch inputs.

It will thus been seen that the objects set forth above, and those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece including an oscillator circuit generating a standard frequency signal, divider network receiving said standard frequency signal and outputting lower-frequency timekeeping signals, timekeeping circuits accumulating said timekeeping signals and outputting signals representative of units of time, display driver means for outputting driving signals, said display driver means receiving said time unit signals from said timekeeping circuits, and a display, said display being driven by signals from said display driver means, comprising:

means for performing at least one supplemental function;

control circuit means for regulating the performance of said at least one supplemental function;

an external member, said external member, when actuated, inputting signals to said control circuit means to modify and select modes of performance, said external member including first and second switch devices, the first said switch device being operated by a linear motion of said external member, the second said switch device being operated by a rotational motion of said external member, said linear switch device being capable of performing an independent control function when said rotational switch device is not operated, said rotational device, when actuated, operating in cooperation with said linear switch device; and means for detecting rotation or non-rotation of said second switch device, said detecting means disabling the performance of said independent control function of said first linear switch device when said second switch device is rotated and enabling performance of said independent control function when said second switch device is not rotated.

2. An electronic timepiece as claimed in claim 1, wherein one of said at least one supplemental functions is an alarm function, said alarm function including an alarm device, said control circuit means being adapted to modify the time setting for said alarm function when said second switch device is rotated.

3. An electronic timepiece as claimed in claim 2, wherein said alarm device is enabled for operation at said set alarm time by said setting of said alarm time.

4. An electronic timepiece as claimed in claim 2, wherein said alarm device emits an audible sound when actuated.

5. An electronic timepiece as claimed in claim 4, wherein said audible alarm device, when actuated, is driven by a first high-frequency signal from said divider network.

6. An electronic timepiece as claimed in claim 2, wherein said control circuit means are adapted to enable and disable said alarm device on independent actuations of said first linear switch device.

7. An electronic timepiece as claimed in claim 1, wherein the number of said at least one supplemental functions is at least two and said control circuit means is adapted to enable one supplemental function of said at least two supplemental functions, to enable both of said at least two supplemental functions, and disable both said at least two supplemental functions in correspondence with successive linear actuations of said external member.

8. An electronic timepiece as claimed in claim 1, wherein the number of supplemental functions is at least two, said at least two suppliemental functions including a 12-hour display mode and a 24-hour display mode, successive linear actuations of said external member alternating said display between said 12- and 24-hour modes.

9. An electronic timepiece as claimed in claim 1, wherein the number of supplemental functions is at least two, said at least two supplemental functions including a seconds display mode and a dates display mode, successive linear actuations of said external member alternating said display between said seconds display and said dates display.

10. An electronic timepiece as claimed in claim 1, wherein said timekeeping circuits include a seconds counter, a minutes counter and an hours counter, rotation of said external member adjusting the count in said minutes counter, linear actuation of said external member setting said divider network and said seconds counter to zero, whereby minutes and seconds can be independently set.

11. An electronic timepiece as claimed in claim 1, wherein said first linear switch device includes a lever connected to said external member and moving linearly with said external member, said lever having click stops holding said lever at selected positions of linear travel of said external member, an electrical terminal, a portion of said lever making contact with said electrical terminal when said lever is held in one of said click stops.

12. An electronic timepiece as claimed in claim 1, wherein said second rotational switch device includes cam means, said cam means being connected to said external member and rotating therewith, and a lever, said lever being pivotably mounted and having resilient portions, rotation of said cam means causing said lever to pivot, and circuit terminals, said resilient portions making contact with said circuit terminals when said lever is pivoted.

13. An electronic timepiece as claimed in claim 12, wherein said resilient portions return said lever to an unpivoted position after each pivoting motion produced by said cam, whereby a series of makes and breaks is produced between said circuit terminals and said resilient portions of said lever when said external member is continuously rotated.

14. An electronic timepiece as claimed in claim 12 or 13, wherein said lever is pivotable in two directions, the pivoting direction being dependent on the rotational direction of said external member, one circuit terminal connecting to said resilient portions when said lever is pivoted in one direction and another circuit terminal connecting to said resilient portions when said lever is pivoted in the other direction.

15. An electronic timepiece as claimed in claim 1, wherein said first linear switch device includes a lever connected to said external member and moving linearly therewith, said lever having click stops holding said lever at positions of linear travel of said external member, a first electrical terminal, a portion of said lever making contact with said first electrical terminal when said lever is held in one of said click stops, and wherein said second rotational switch device includes cam means connected to said external member and rotating therewith, said lever being pivotably mounted and having resilient portions, rotation of said cam means causing said lever to pivot, and second electrical terminals, said resilient portions making contact with said second electrical terminals when said lever is pivoted.

16. An electronic timepiece as claimed in claim 15, wherein said resilient portions return said lever to an unpivoted position after each pivoting motion, whereby a series of makes and breaks is produced between said second electrical terminals and said resilient portions when said external member is continuously rotated.

17. An electronic timepiece as claimed in claim 16, wherein said lever is pivotable in two directions, the pivoting direction being dependent on the rotational direction of said external member, one circuit terminal connecting to said resilient portions when said lever is pivoted in one diredtion and another circuit terminal connecting to said resilient portions when said lever is pivoted in the other direction.

18. An electronic timepiece including an oscillator circuit generating a standard frequency signal, a divider network receiving said standard frequency signal and outputting lower-frequency timekeeping signals, timekeeping circuits accumulating said timekeeping signals and outputting signals representative of units of time, display driver means for outputting driving signals, said display driver means receiving said time unit signals from said timekeeping circuits, and a display, said display being driven by signals from said display driver means, comprising:

mean for performing at least two supplemental functions, one of said at least two supplemental functions being an alarm function, another one of said at least two supplemental functions is a time unit marker device;

control circuit means for regulating the performance of said at least two supplemental functions;

an external member, said external member, when actuated, inputting signals to said control circuit means to modify and select modes of performance, said external member including first and second switch devices, the first said switch device being operated by a linear motion of said external member, the second said switch device being operated by a rotational motion of said external member, said linear switch device being capable of performing an independent control function when said rotational switch device is not operated, said rotational device, when actuated, operating in cooperation with said linear switch device; and said alarm function including an alarm device, said control circuit means being adapted to modify the time setting for said alarm function when said second switch device is rotated, and said control circuit means is further adapted to enable one of said alarm or marker functions, enable both said alarm and marker functions, or disable both said alarm and marker functions in correspondence with successive actuations of said linear switch device.

19. An electronic timepiece as claimed in claim 18, wherein said time unit marker device emits an audible sound when actuated.

20. An electronic timepiece as claimed in claim 19, wherein said marker device, when actuated, is driven by a second high-frequency signal from said divider network.

21. An electronic timepiece as claimed in claim 20, wherein said audible marker sound is emitted on the hour.

* * * * *